United States Patent [19]

Kelly et al.

[11] 4,391,634

[45] Jul. 5, 1983

[54] WELDABLE OXIDE DISPERSION STRENGTHENED ALLOYS

[75] Inventors: Thomas J. Kelly, Suffern; Mark L. Robinson, Warwick, both of N.Y.

[73] Assignee: Huntington Alloys, Inc., Huntington, W. Va.

[21] Appl. No.: 353,036

[22] Filed: Mar. 1, 1982

[51] Int. Cl.[3] ..... C22C 38/06; C22C 38/18; C22C 38/24; C22C 38/26

[52] U.S. Cl. ..... 75/124

[58] Field of Search ..... 75/124 F, 0.5 BC, 0.5 AC; 428/638, 639

[56] References Cited

U.S. PATENT DOCUMENTS

| | | | |
|---|---|---|---|
| 3,131,055 | 4/1964 | Behar | 75/124 F |
| 3,782,925 | 1/1974 | Brandis | 75/124 F |
| 3,813,240 | 5/1974 | Abe | 75/124 F |
| 3,837,930 | 9/1974 | Cairns et al. | 148/11.5 F |
| 3,992,161 | 1/1976 | Cairns et al. | 29/182.5 |

OTHER PUBLICATIONS

T. J. Kelly, "Joining of Oxide Dispersion Strengthened Alloys", Paper Presented at Frontiers of High Temperature Materials Conference, May 18-21, 1981.

R. E. Yount et al, "Development of Joining Techniques for TD Nickel-Chromium", TR No. AFML-TR-6-7-224, Oct., 1967.

R. E. Yount et al, "Joining Techniques for Thoria Dispersion Strengthened Materials", SAMPE, Advanced Techniques for Material Investigation and Fabrication, Nov., 1968.

M. Hasegawa et al, "Strengthening of Steel by the Method of Spraying Oxide Particles into Molten Steel Stream", Met Trans, vol. 9B, pp. 383-388, Sep. 1978.

J. J. Fischer et al, "The Structure and Properties of D-S Fe-Cr-Al Alloy, Incoloy Alloy MA 956E", Superalloys-Metallurgy and Manufacture, AIME, 1976.

*Primary Examiner*—W. Stallard

*Attorney, Agent, or Firm*—Miriam W. Leff; Raymond J. Kenny

[57] ABSTRACT

A weldable oxide dispersion strengthened alloy which provides improved welds and welded structures of oxide dispersion strengthened materials is characterized by good retention of dispersoid distribution in the fusion weld zone.

25 Claims, 6 Drawing Figures

WELDABLE OXIDE DISPERSION STRENGTHENED ALLOYS

This invention relates to an alloy for joining oxide dispersion strengthened iron-base alloys and to the welds and welded structures made therefrom. More particularly, it relates to an alloy having good retention of dispersoid distribution during fusion welding.

BACKGROUND OF THE INVENTION

There has been a concerted effort to develop alloys which will withstand the increasingly more severe conditions required by modern technology. To be of practical utility in many applications, it is also necessary to be able to weld the alloy. Among the high temperature alloys proposed is an iron-chromium-aluminum dispersion-strengthened alloy system, described in detail in U.S. Pat. No. 3,837,930 and No. 3,990,161, which has high temperature strength, good room temperature ductility even after exposure to high temperatures, and exhibits grain stability at elevated temperatures. In general, alloys of the system are composed (by weight) of about 10–40% Cr, about 1–10% Al, up to 10% Ni, up to 10% Co, up to 5% Ti, up to 2% each of rare earth metal, yttrium, zirconium, niobium, hafnium, tantalum, silicon and vanadium, up to 6% each tungsten and molybdenum, up to 0.4% carbon, up to 0.4% manganese and the balance essentially iron, and they include a refractory dispersoid which may range from very small amounts, e.g. (by volume) about 0.1% or less up to about 10% or more. It has been found, however, that when certain alloys in this system are subjected to fusion welding, the dispersoid tends to ripen or agglomerate, and the grain boundaries tend to form transverse to the original microstructure. Such alloys tend to lose high temperature strength at the welds.

Heretofore, it was considered advantageous to incorporate small amounts of titanium, e.g. about 0.5%, in the alloys in order to prevent brittleness that nitrogen in the alloy might cause. Nirtogen is often picked up in preparing the alloy powder. Titanium-containing alloys have been made which have good tensile strength and stress rupture properties at temperatures as high as 1093° C. (2000° F.). However, these alloys tend to lose strength at the welds and this precludes the advantageous use of the alloys in various high temperature applications for which they might otherwise be used.

It has now been found that titanium, which is beneficial in other ways in the iron-chromium-aluminum dispersion strengthened alloys, offers no special advantage in such alloys when they are subjected to fusion welding.

It is the object of the present invention to provide a weldable iron-base dispersion strengthened alloy. A further object is to provide a weldable iron-chromium-aluminum dispersion strengthened alloy. Another object is to provide an alloy with superior weldability for high temperature e.g. 1093° C. (2000° F.) applications. The invention also contemplates providing a welded structure made of an iron-chromium-aluminum dispersion strengthened alloy, which structure is characterized by sound, high strength, and autogeneous weld deposits.

Other objects and advantages will be apparent from the drawings and description which follow.

BRIEF DESCRIPTION OF THE DRAWINGS

FIGS. 1*a* through 3*b* illustrate comparisons of dispersoid distribution in the base metal and fusion zone of welds for various alloys, as explained in greater detail below.

THE INVENTION

Figure 1A:
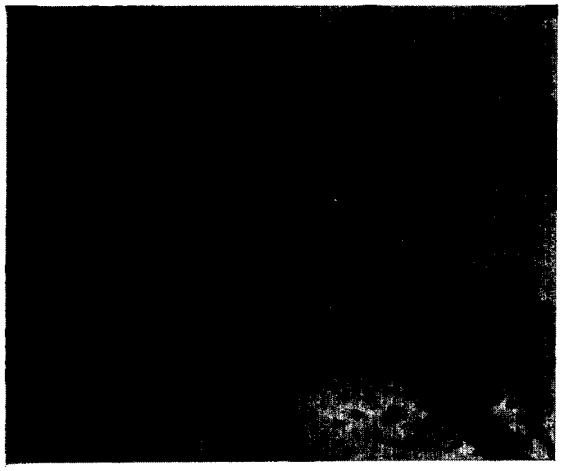
FIGS. 1*a* and 1*b* are thin foil micrographs from a transmission electron microscope (TEM)

In accordance with the present invention, it has been found that the problem of dispersoid agglomeration and alloy instability in the weld zone in certain iron-chromium-aluminum dispersion strengthened alloys is attributable at least in part to the presence of titanium. Furthermore, replacing titanium with tantalum, niobium or hafnium the resultant alloy can be fusion welded with greater retention of dispersion strengthening. Such replacement has improved the as-welded grain structure, which results in improved high temperature properties.

In general, weldable alloys of the present invention are ferritic alloys which are dispersion strengthened with a refractory oxide and on being fusion welded are characterized by substantial retention of their dispersoid distribution in the fusion zone, said ferritic alloys being substantially titanium-free and comprising chromium, aluminum and iron, and at least one of the additive elements tantalum, niobium and hafnium in a minor amount. The present alloy is comprised, by weight, of about 10 to about 40% chromium, about 1 to about 10% aluminum, a small but effective amount for increased strength up to about 6% total of at least one of the group tantalum, niobium and hafnium, and the balance essentially iron, and further contains a small but effective amount for improved high temperature strength up to about 10% of an oxide dispersoid.

Advantageously, the chromium level is about 12 up to about 25 or 30%, and preferably it is about 19 to about 21%. Below about 12% the alloy may undergo undesirable phase transformations on heating and cooling. Above about 30% the alloy tends to be brittle.

Advantageously, the aluminum level is about 1½ to about 10%, preferably the aluminum level is above about 3%, and more preferably the aluminum level is about 4–5%. Greater than about 10% aluminum may cause undesirable intermetallic phases to form. Less than about 1½% aluminum may degrade oxidation resistance by preventing the formation of an alumina scale.

The alloy is substantially titanium-free as indicated above, but it can tolerate traces of titanium. Generally, the titanium level should be less than 0.05%.

At least one of the additives is present as an additive in the present invention. Advantageously, the level of each of the additive elements tantalum, niobium and hafnium is about ¼% to about 4 or 5%, respectively. Preferably, the tantalum is present in an amount from about 1% to about 2%, the niobium is present in an amount from about 0.5% to about 2%, and the hafnium about 1 to about 2%. Preferably, no more than a total of 6% Ta, Nb and Hf is present, and more preferably the additive is only tantalum. It is generally recognized by those skilled in the art that only one carbide or nitride former is required for the particular effect desired. Thus, if tantalum is added, typically it will be the only additive. However, as indicated, more than one additive may be present so long as the total amount does not exceed about 6%, and preferably the total does not exceed 3%. Apart from the tantalum, niobium and hafnium, and the dispersoids, weldable alloys of the present invention may contain small amounts of other elements that do not interfere with the fusion welding characteristic properties of the alloy. In general, however, the molybdenum, tungsten, rare earth metals, yttrium, silicon and boron should be as low as possible.

The oxide dispersoid content of the alloy may range from a small but effective amount for increased high temperature strength up to about 2 or 3 volume % or even as high as 10%. Preferably, the dispersoid level is less than 1½% for high temperature use. For example, the alloy may contain 0.1 volume % oxide dispersoid. With a dispersoid content of about 0.3 to 0.6 weight % (0.5 wt % $Y_2O_3$=0.72 vol. %), the room temperature tensile strength of Cr-Al-Fe alloys of this invention are typically over about 600 MPa (87 ksi), e.g. about 645 MPa (93.5 ksi) or 657 MPa (95.3 ksi) and higher. The alloy with ½ weight % dispersoid level will, typically, withstand a stress of about 40 MPa, e.g. 41.4 MPa (6 ksi), for 24 hrs at about 1093° C. (2000° F.). The weld will withstand a stress of at least about 20.7 MPa for about 1000 hours at about 1093° C. (2000° F.).

As will be understood by those skilled in the art, the use of the expression "balance essentially iron" does not exclude the presence of other elements commonly present as incidental constituents and impurities.

Alloys of the present composition can be welded using the usual types of welding, and advantageously with fusion welding techniques used for joining sheet, e.g., electron beam welding, resistance welding, laser welding and micro-plasma welding.

The welded structures produced using the present alloys are characterized by a high room temperature tensile strength and ductility, and good stress rupture properties relative to the titanium-containing alloys of this type. Such structures can be used particularly advantageously at high temperature (viz. up to about 1100° C.) for extended periods.

For the purpose of giving those skilled in the art, a better understanding of the invention, the following illustrative examples are given.

EXAMPLE 1

Eleven alloy compositions are prepared with substantially the same Cr, Al, Fe and refractory oxide dispersoid content, except that the composition is varied with respect to the titanium, tantalum, niobium and hafnium contents as shown in Table I. As shown in Table I, Sample 2 contained no titanium nor any substitute therefor.

The compositions are prepared by mechanical alloying of powders to give the indicated compositions. The powders are extruded at an elevated temperature, hot rolled and cold rolled to produce a sheet 1.14 mm (0.045") in thickness. The material is subjected to a final anneal for recrystallization. Conditions were not optimized for recrystallization of the 2.1% Hf-containing sample to a coarse grain structure.

TABLE I

| | CHEMICAL COMPOSITION IN WEIGHT % | | | | | | | |
|---|---|---|---|---|---|---|---|---|
| Sample | % Cr | % Al | % $Y_2O_3$ | % Ta | % Hf | % Nb | % Ti | % Fe |
| X | 19.1 | 4.6 | 0.50 | | | | 0.50 | Bal. |

TABLE I-continued

| | CHEMICAL COMPOSITION IN WEIGHT % | | | | | | | |
|---|---|---|---|---|---|---|---|---|
| Sample | % Cr | % Al | % $Y_2O_3$ | % Ta | % Hf | % Nb | % Ti | % Fe |
| 1 | 18.4 | 4.3 | 0.41 | — | — | — | — | Bal. |
| 2 | 19.7 | 4.3 | 0.39 | 0.42 | — | — | — | Bal. |
| 3 | 19.0 | 4.4 | 0.39 | 1.1 | — | — | — | Bal. |
| 4 | 18.7 | 4.3 | 0.39 | 1.9 | — | — | — | Bal. |
| 5 | 19.7 | 4.3 | 0.36 | — | 0.49 | — | — | Bal. |
| 6 | 19.6 | 4.4 | 0.43 | — | 1.2 | — | — | Bal. |
| 7 | 19.6 | 4.5 | 0.41 | — | 2.1 | — | — | Bal. |
| 8 | 19.4 | 4.3 | 0.41 | — | — | 0.49 | — | Bal. |
| 9 | 20.0 | 4.3 | 0.39 | — | — | 1.2 | — | Bal. |
| 10 | 19.5 | 4.3 | 0.39 | — | — | 2.0 | — | Bal. |

EXAMPLE 2

The purpose of this example is to compare the mechanical properties of welded and unwelded alloys of the compositions in Table I.

Samples of sheet made as described in Example 1 are prepared for welding trials by belt sanding and cutting to the required sizes for each test. Welding, done by an electron beam welder, is carried out as butt welds and seam welded lap joints. Butt welds are made as bead-on-plate welds through the thickness of the samples. Seam welded lap joints are made in a fixture which holds the weld at a 7° angle with respect to the energy beam. Specimens of each welding configuration and each composition are made for room temperature tensile, elevated temperature and stress rupture testing.

A. Tensile & Ductility Tests

Data compiled in Table II illustrate the comparison of room temperature tensile strength and ductility of welded and unwelded compositions. The data represent average values.

The data in Table II show that alloys containing 1.1% Ta and 1.2% Hf display a 93% recovery of base metal ultimate tensile strength (UTS), while the 1.2% Hf sample also has a 69% recovery of base metal ductility. Although Hf-containing alloys all have lower base metal ductility than the Ta-containing alloys, the 1.2% Hf-containing alloy weld has better ductility in absolute terms than the 1.2% Ta-containing alloy weld.

The 2.0% Nb sample has a room temperature base metal ultimate tensile strength of approximately 82.7 MPa (12 ksi) greater than the Ti-containing alloy used for comparison. Even with this higher base metal strength the weld recovered 96% of the base metal ultimate tensile strength, which makes the as-welded condition about 10% stronger than the Ti-containing sheet. Recovery of base metal ductility is only 36% which, though not good, was not much worse than any of the other welds with comparable base metal ductility.

The as-welded 1.2% Hf-containing sample achieved the closest duplication of the standard base metal properties of any alloy modification tested.

Tensile tests at 1093° C. (2000° F.) show that the electron beam butt welded samples recovered 51% of their strength, but had essentially no ductility.

TABLE II

COMPARISON OF AVERAGE ROOM TEMPERATURE MECHANICAL PROPERTIES OF WELDED AND UNWELDED ALLOYS

| Sample | Ti or Substitute | Type of Weld | U.T.S. MPa | U.T.S. (ksi) | % El. |
|---|---|---|---|---|---|
| X | 0.5% Ti | Unwelded | 719.8 | (104.4) | 13.0 |
| 1 | None | Unwelded | 704 | (102.1) | 12.5 |

TABLE II-continued

COMPARISON OF AVERAGE ROOM TEMPERATURE MECHANICAL PROPERTIES OF WELDED AND UNWELDED ALLOYS

| Sample | Ti or Substitute | Type of Weld | U.T.S. MPa | U.T.S. (ksi) | % El. |
|---|---|---|---|---|---|
| 1 | None | E. B. Butt | 666 | (96.6) | 6.0 |
| 2 | 0.42% Ta | Unwelded | 736 | (106.7) | 11.0 |
| 2 | 0.42% Ta | E. B. Butt | 662 | (96.0) | 5.0 |
| 3 | 1.1% Ta | Unwelded | 722 | (104.7) | 14.0 |
| 3 | 1.1% Ta | E. B. Butt | 672 | (97.5) | 2.5 |
| 4 | 1.9% Ta | Unwelded | 745 | (107.9) | 10.5 |
| 4 | 1.9% Ta | E. B. Butt | 643 | (93.3) | 4.0 |
| 5 | 0.49% Hf | Unwelded | 724 | (104.9) | 9.5 |
| 5 | 0.49% Hf | E. B. Butt | | | 4.5 |
| 6 | 1.2% Hf | Unwelded | 727 | (105.3) | 8.0 |
| 6 | 1.2% Hf | E. B. Butt | 674 | (97.7) | 5.5 |
| 7 | 2.1% Hf | Unwelded | 1030 | (149.4) | 7.0 |
| 7 | 2.1% Hf | E. B. Butt | 715 | (103.6) | nil |
| 8 | 0.49% Nb | Unwelded | 748 | (108.4) | 13.0 |
| 8 | 0.49% Nb | E. B. Butt | 674 | (97.7) | N.R. |
| 9 | 1.2% Nb | Unwelded | 789 | (114.3) | 13.0 |
| 9 | 1.2% Nb | E. B. Butt | 708 | (102.7) | 4.5 |
| 10 | 2.0% Nb | Unwelded | 805 | (116.6) | 12.5 |
| 10 | 2.0% Nb | E. B. Butt | 779 | (112) | 4.5 |

N.R. = Not Recorded

B. Stress Rupture Tests

Stress rupture tests on three specimens of each of the compositions of Table I, using a step loading technique at 24 hours at a given stress before increasing the load, show that all ten compositions passed a 41.4 MPa (6 ksi), 24 hour test at 1093° C. (2000° F.).

Tests on the welded samples did not survive the same load. However, the tests show that both the 1.1% and 1.9% Ta-containing heats in seam lap welded configuration supported a 34.5 MPa (5 ksi) stress for some period of time at 1093° C. (2000° F.) before failing through the base metal during the step loading procedure. In addition, a butt weld of the 1.1% Ta-containing heat supported a 13.8 MPa (2 ksi) stress for 64.7 hours at 1093° C. (2000° F.). A 64.7-hour life at this temperature and stress is considered very good for a fusion butt welded oxide dispersion strengthened alloy.

An evaluation of the stress rupture results shows the weldments of the Ta-containing samples to be stronger than the Hf- and Nb- containing samples.

A review of failed weldments after stress rupture testing reveals that the specimens fail through the base metal, frequently after crack initiation in the fusion zone. Base metal failure seemed to be the limiting factor in determining the stress rupture strength of the weldments regardless of alloy content. This is probably due to the configuration of the seam welded lap joint stress rupture specimens.

EXAMPLE 3

The purpose of this example is to illustrate the dispersoid distribution in the fusion zone of welded specimens compared with that in unmelted base metal samples of the same composition.

Dispersoid distribution was determined both by transmission electron microscopy (TEM) from thin foils and by examination of replicas taken from a polished and etched fusion zone of several welds, and they were compared to replicas from unmelted base metal samples of the same composition.

Figure 1B:
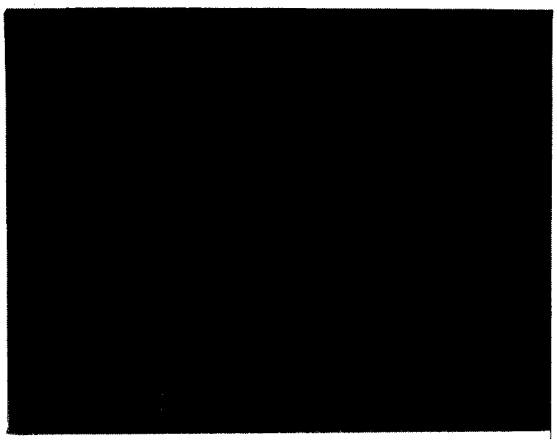

FIGS. 1*a* and 1*b* are thin foil micrographs (at 25,500× and 15,000×, respectively) in which the dispersoid distribution in an unmelted base metal (FIG. 1*a*), having a nominal composition comparable to that of Sample X of Table I (i.e. containing 0.5% Ti), is compared with the dispersoid distribution in the fusion zone of an alloy of the same composition (FIG. 1*b*). FIG. 1*b* shows that the dispersoid has ripened and that the small background dispersoid has been lost from the fusion zone.

Figure 2:
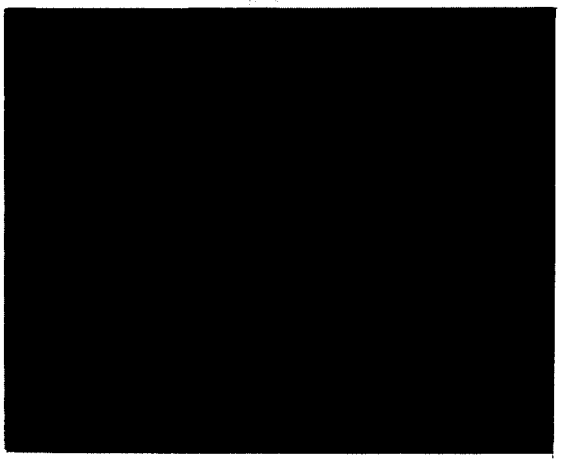
FIGS. 2, 3*a* and 3*b* are transmission electron microscopy replicas from the fusion zone of welds.

FIG. 2, which is a representative photomicrograph of a replica TEM (at 15,000×) in the fusion zone of an alloy having the composition of Sample 1 of Table I (i.e. having no Ti or any substitute therefor in the alloy), is substantially the same as that for the Ti-containing version, showing that simply removing the Ti from the alloy will not improve the dispersoid distribution in the welds.

Figure 3A:
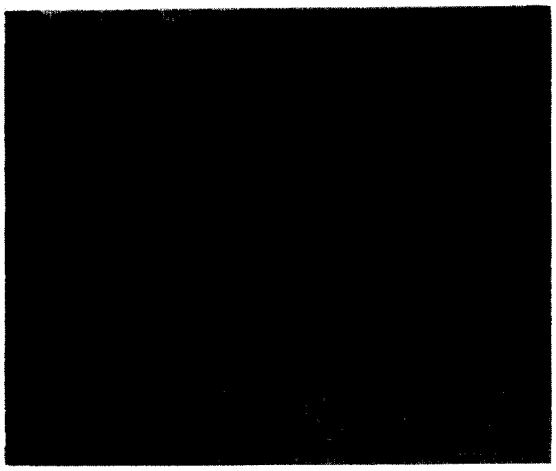
Figure 3B:
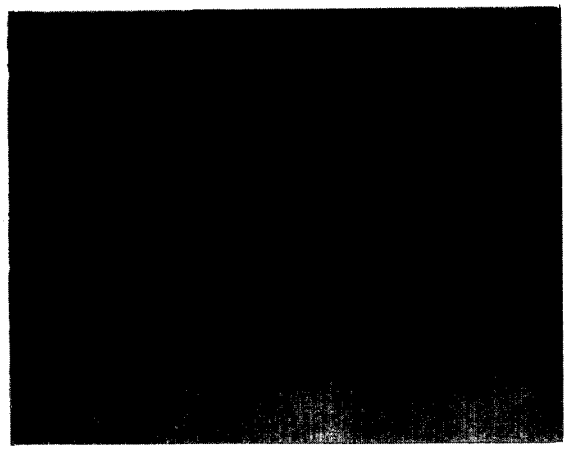

FIGS. 3*a* and 3*b*, replica TEM micrographs at 15,000×, compare the dispersoid distribution in an unmelted base metal (FIG. 3*a*) having the composition of Sample 4 of Table I (i.e. containing 1.9% Ta) with the dispersoid distribution in the fusion zone (FIG. 3*b*) of an alloy of the same composition. FIGS. 3*a* and 3*b* show that the dispersoid distribution in the fusion zone (FIG. 3*b*) approached that of the base metal (FIG. 3*a*). The dispersoid distribution in the fusion zone appeared to improve as the Ta level increased from 0.42 to 1.9%. Examination of similar TEM replicas for Hf and Nb alloys showed that the dispersoid distribution was best for Hf-containing alloys with 2.1% Hf. Above 0.49% Nb there appears to be no further improvement in the dispersoid distribution in the fusion zone.

Figure 4:
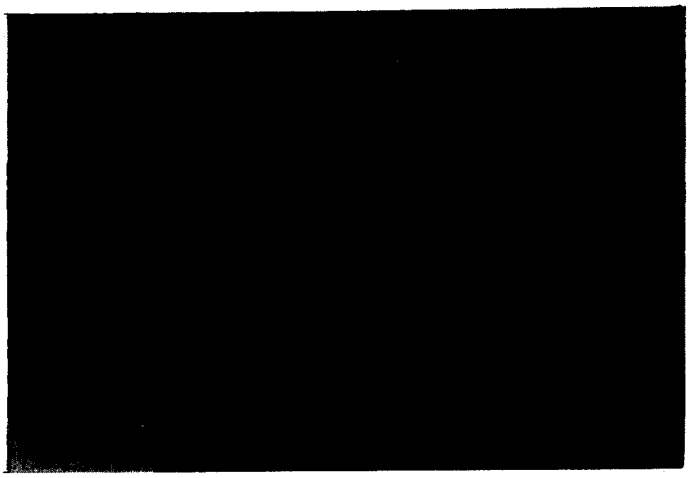
FIG. 4 is an optical micrograph showing a cross section of an electron beam weld of an alloy of the present invention.

Cross sections of electron beam butt welds were also subjected to metallographic examination. Some porosity was found in the fusion zone. Several Ta- and Nb-containing alloys showed epitaxial growth through the fusion zone. FIG. 4, which is an optical photomicrograph at 50× showing a cross-section of an electron beam weld of an alloy of the present invention containing 1.1% tantalum, shows that there is an absence of grain boundaries in the fusion zone. It is believed that this type of structure would be advantageous for good stress-rupture properties. Of the compositions examined, the 1.1% Ta-containing appeared to be the best of the Ta-containing compositions, the 1.2% Nb the best of the Nb-containing compositions and the 1.2% Hf the best of the Hf-containing compositions. Of the compositions examined the Ta-containing alloys are superior to the Nb and Hf modifications.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A weldable refractory-oxide dispersion strengthened alloy affording oxidation resistance and strength at elevated temperatures, said alloy being ferritic and substantially titanium-free and consisting essentially, by weight, of about 10 to about 40% chromium, about 1 to about 10% aluminum, a minor amount of at least one of the additives tantalum, niobium and hafnium and the balance essentially iron, and said alloy being characterized on fusion welding by good oxide dispersoid distribution in the weld zone.

2. A weldable alloy as defined in claim 1, wherein at least one of the additives tantalum, niobium and hafnium is present in an amount, by weight, of a small but effective amount for improved oxidation resistance and the total amount of said additives is up to about 6%.

3. A weldable alloy as defined in claim 1, wherein at least one of the additives tantalum, niobium and hafnium is present in an amount, by weight, of at least ¼%.

4. A weldable alloy as defined in claim 2, wherein at least one of the additives tantalum, hafnium and niobium is present in an amount, by weight of about 1.4% up to about 5%, the total amount of said additives being up to about 6%.

5. A weldable alloy as defined in claim 2, wherein at least one of the additives tantalum, hafnium and niobium is present, said tantalum level (if present) is about 1 to about 2%, said niobium level (if present) is about 0.5 to about 2%, and said hafnium level (if present) is about 1 to about 2%.

6. A weldable alloy as defined in claim 1, wherein the dispersoid level is a small but effective amount for increased high temperature strength up to about 10 volume % (based on the total volume of the alloy).

7. A weldable alloy as defined in claim 1, wherein the dispersoid level is a small but effective amount for increased high temperature strength up to about 3 volume % (based on total volume of the alloy).

8. A weldable alloy as defined in claim 3, wherein the dispersoid level is a small but effective amount for increased high temperature strength up to about 1½% volume % (based on the total volume of the alloy).

9. A weldable alloy as defined in claim 1, wherein the dispersoid comprises yttria, and said yttria is present in an amount up to about 1½ weight %.

10. A weldable alloy as defined in claim 2, wherein the additive is tantalum.

11. A weldable alloy as defined in claim 1, wherein the alloy consists essentially of (by weight) about 12 up to about 30% chromium; about 1½ up to about 10% aluminum; less than about 0.05% titanium; and up to about 6% total of at least one additive from the group selected from tantalum, niobium and hafnium and the balance essentially iron, and said alloy contains up to about 3% by volume of a dispersoid.

12. A weldable alloy as defined in claim 1, wherein the weldable alloy consists essentially, by weight, of about 19 to about 21% chromium; about 4 up to about 5% aluminum; up to about 2% of at least one of the additives tantalum, niobium and hafnium and the balance essentially iron, and wherein the titanium level is less than about 0.05%.

13. A weldable alloy as defined in claim 1, wherein the alloy has a room temperature tensile strength after welding of over about 600 MPA.

14. A weldable alloy as defined in claim 1, wherein the alloy can withstand a stress of at least about 20.7 MPa for about 1000 hours at about 1093° C.

15. A weldable alloy as defined in claim 1, wherein the alloy can withstand a stress of at least about 40 MPa for about 24 hours at about 1093° C.

16. A weldable alloy as defined in claim 1, wherein the alloy is prepared by a process comprising mechanical alloying.

17. In a process for producing by welding a composite structure including at least one member made of Cr-Al-Fe oxide-dispersion strengthened alloy, the improvement which comprises forming a fusion weld in the structure using a weldable alloy, said weldable alloy being a ferritic oxide dispersion strengthened alloy which is substantially titanium-free and contains a minor amount of at least one of the additives tantalum, niobium or hafnium.

18. A process as defined in claim 17, wherein the tantalum, niobium and hafnium are present in the alloy in an amount, by weight, of about ¼% up to about 6%, the total amount of additive being up to about 6%.

19. A process as defined in claim 13, wherein the additive is tantalum.

20. A process as defined in claim 13, wherein the dispersoid level of the oxide dispersion strengthened alloy is a small but effective amount for increased strength up to about 10% by volume.

21. A process as defined in claim 13, wherein the dispersoid comprises yttria.

22. As a new article of manufacture, a welded structure comprised of at least one oxide dispersion strengthened, ferritic member comprised of iron-chromium-aluminum, said member having a fusion weld deposit characterized by good dispersoid distribution and said welded structure having a room temperature strength of at least 600 MPa said oxide dispersion strengthened alloy being substantially titanium-free and consisting essentially, by weight, of about 12 to about 30% chromium, about 1½ to about 10% aluminum and in addition containing from ¼% up to about 6% total of at least one additive selected from the group tantalum, niobium and hafnium, and the balance essentially iron, and further containing a small but effective amount for increased high temperature strength up to about 10% by volume of an oxide dispersoid.

23. A welded structure in accordance with claim 22, wherein the alloy contains about 19% up to about 21% chromium, about 4 up to about 5% aluminum, up to about 2% of at least one of the additives tantalum, niobium and hafnium and the balance essentially iron.

24. A welded structure in accordance with claim 22, wherein at least one of the additives is present in an amount, by weight of about 0.4 up to about 2%.

25. A welded structure in accordance with claim 24, wherein the oxide dispersoid is yttria and said yttria is present in an amount of about 0.3 up to about 0.6%, by weight.

* * * * *